US006428450B1

(12) United States Patent
Ho et al.

(10) Patent No.: US 6,428,450 B1
(45) Date of Patent: Aug. 6, 2002

(54) SIT-UP EXERCISING APPARATUS

(76) Inventors: Wei-Teh Ho; Keith Mirchandani, both of P.O. Box 24-108, Taipei (TW)

( * ) Notice: Subject to any disclaimer, the term of this patent is extended or adjusted under 35 U.S.C. 154(b) by 0 days.

(21) Appl. No.: 09/861,499

(22) Filed: May 21, 2001

(51) Int. Cl.[7] ..... A63B 26/00; A63B 71/00

(52) U.S. Cl. ..... 482/140; 482/95; 482/96; 482/72; 482/130

(58) Field of Search ..... 482/140, 71–72, 482/62, 101, 91, 95, 96, 130, 148

(56) References Cited

U.S. PATENT DOCUMENTS 4,746,114 A * 5/1988 Grider ..... 272/123
5,277,684 A * 1/1994 Harris ..... 482/130
5,702,334 A * 12/1997 Lee ..... 482/140
5,716,308 A * 2/1998 Lee ..... 482/130
5,795,270 A * 8/1998 Woods et al. ..... 482/72
5,810,698 A * 9/1998 Hullett et al. ..... 482/96
5,833,590 A * 11/1998 Chiu et al. ..... 482/142
5,868,654 A * 2/1999 Norian ..... 482/140
5,993,363 A * 11/1999 Chen ..... 482/138
D419,750 S * 2/2000 Steinmetz ..... 482/11
6,090,022 A * 7/2000 Colecchi ..... 482/131
6,093,135 A * 7/2000 Huang ..... 482/72
6,106,445 A * 8/2000 Lay ..... 482/142
6,162,153 A * 12/2000 Perez, Jr. et al. ..... 482/96
6,206,808 B1 * 3/2001 Ho ..... 482/95
6,206,809 B1 * 3/2001 Habing et al. ..... 482/96
6,213,923 B1 * 4/2001 Cameron et al. ..... 482/142
6,244,995 B1 * 6/2001 Prsala ..... 482/96

* cited by examiner

*Primary Examiner*—Michael A. Brown
*Assistant Examiner*—Lori Baker Amerson

(57) ABSTRACT

A sit-up exercising apparatus includes a base frame fixedly provided with a seat cushion, a swinging back cushion pivoted to a middle part of the base frame and turned up and down within an angle, a stop frame bar adjustably fastened to the base frame to limit the swinging angle of the swinging back cushion, two smoothly curved tracks provided at two sides of the base frame, and two handles connected in parallel to the swinging back cushion and respectively slidably coupled to the smoothly curved tracks.

4 Claims, 5 Drawing Sheets

SIT-UP EXERCISING APPARATUS

BACKGROUND OF THE INVENTION

The present invention relates to exercising apparatus and, more particularly, to a sit-up exercising apparatus, which comprises a swinging back cushion adapted to support and to move with the user's back when the user turns the upper part of the body alternatively up and down and alternatively pulls and releases two handles, and an adjustable stop frame bar adapted to limit the swinging angle of the swinging back cushion.

Various exercising apparatus have been disclosed for different exercising purposes, and have appeared on the market. FIG. 5 shows a sit-up exercising apparatus constructed according to the prior art. This structure of sit-up exercising apparatus is not comfortable in use because it has no means to support the user's body. Furthermore, this structure of sit-up exercising apparatus cannot be adjusted to fit users of different ages or physical conditions.

SUMMARY OF THE INVENTION

The present invention has been accomplished to provide a sit-up exercising apparatus, which eliminates the aforesaid drawbacks. It is one object of the present invention to provide a sit-up exercising apparatus, which is comfortable in use. It is another object of the present invention to provide a sit-up exercising apparatus, which fits users of different ages and different physical conditions. According to one aspect of the present invention, the sit-up exercising apparatus comprises a base frame fixedly provided with a seat cushion, a swinging back cushion pivoted to a middle part of the base frame and turned up and down within an angle, a stop frame bar fastened to the base frame to limit the swinging angle of the swinging back cushion, two smoothly curved tracks provided at two sides of the base frame, and two handles connected in parallel to the swinging back cushion and respectively slidably coupled to the smoothly curved tracks. According to another aspect of the present invention, the base frame comprises two longitudinal rows of mounting holes disposed at two opposite lateral sides, and the stop frame bar is selectively fastened to the longitudinal rows of mounting holes to limit the swinging angle of the swinging back cushion to fit different users.

DETAILED DESCRIPTION OF THE PREFERRED EMBODIMENT

Figure 1:
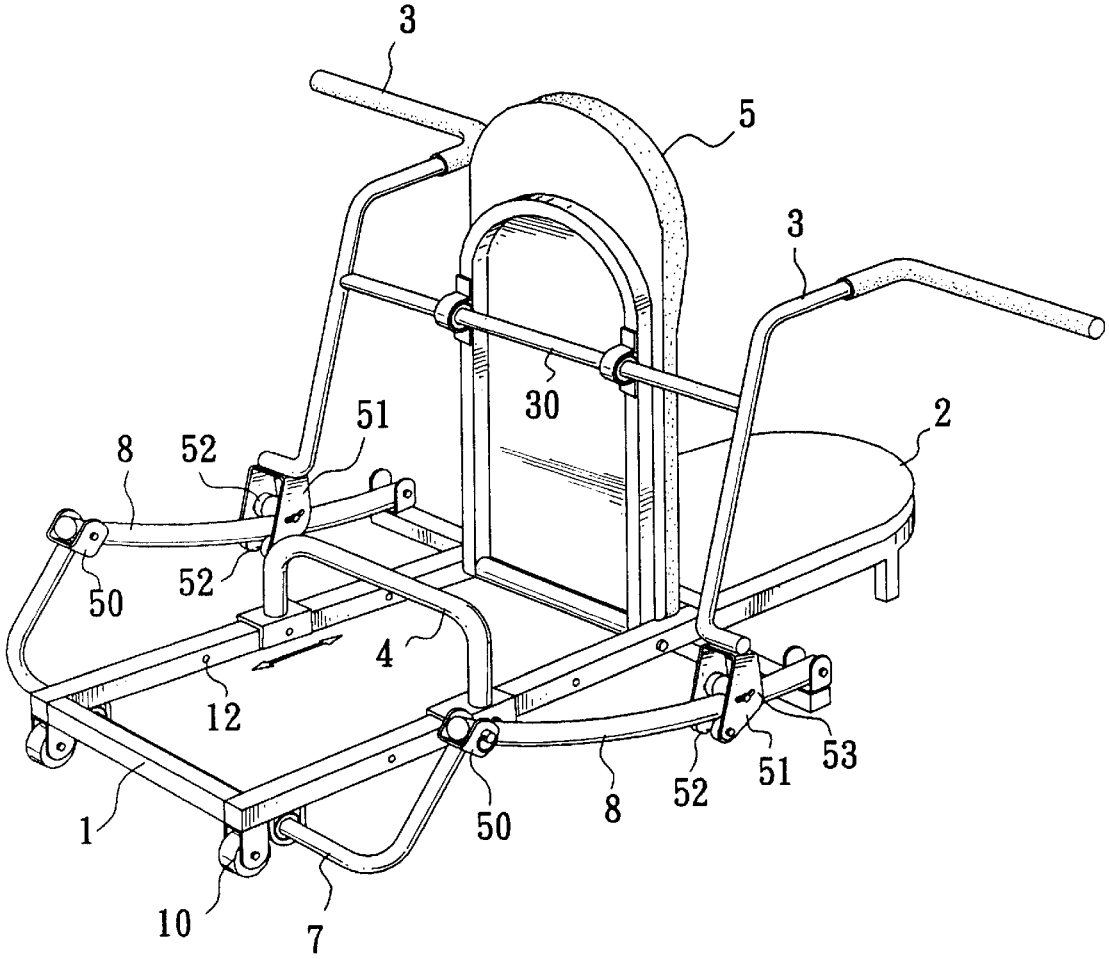
FIG. 1 is a perspective view of a sit-up exercising apparatus according to the present invention.
Figure 2:
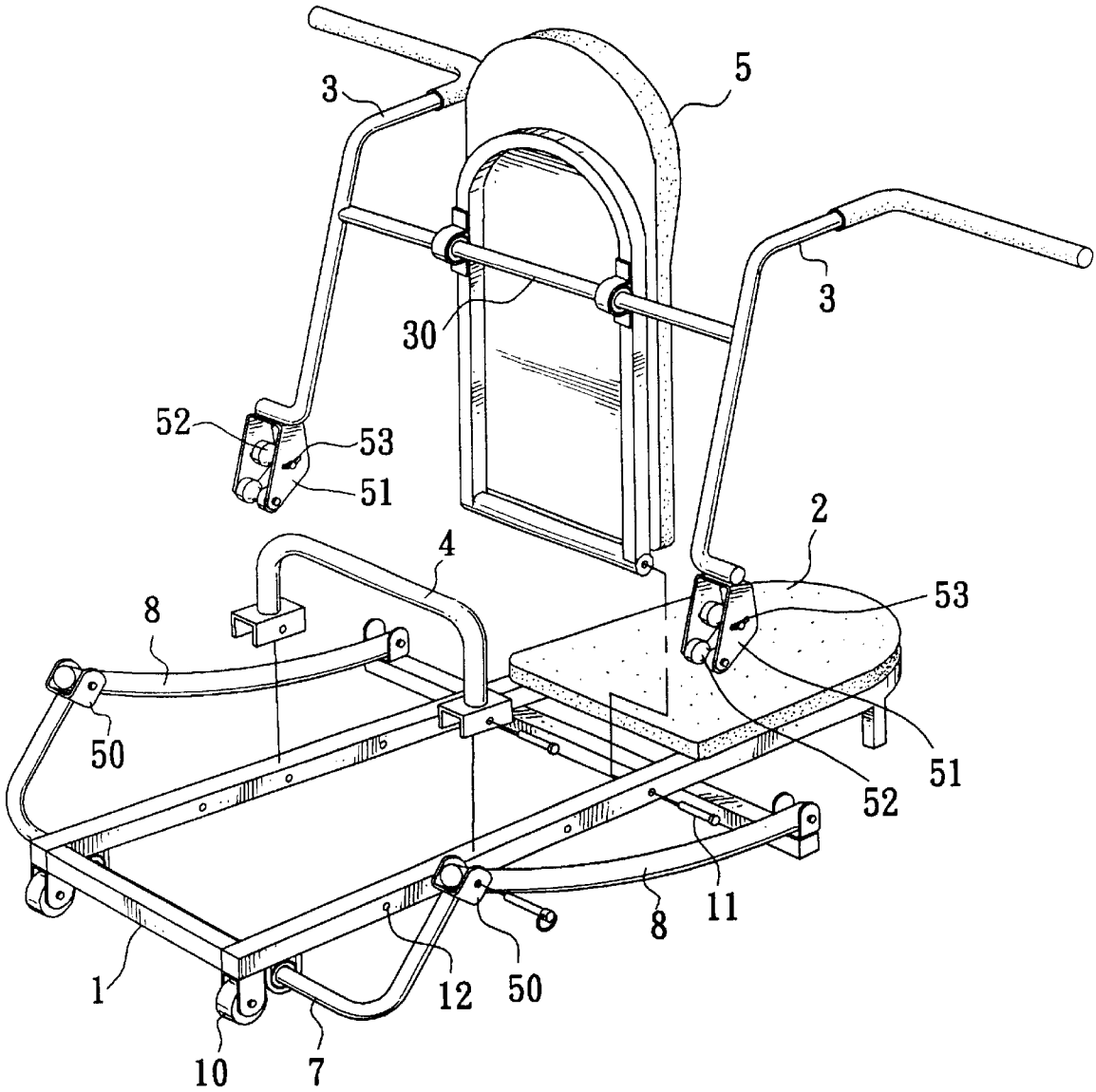
FIG. 2 is an exploded view of the sit-up exercising apparatus according to the present invention.

Referring to FIGS. from 1 through 3, a sit-up exercising apparatus in accordance with the present invention is generally comprised of a base frame 1, a fixed sit cushion 2, two handles 3, a stop frame bar 4, a swinging back cushion 5, a rear bracket 7, and two smoothly curved guide bars 8.

The base frame 1 is to be positioning on the floor, having two wheels 10 bilaterally disposed at the rear side thereof and two longitudinal rows of mounting holes 12 aligned at two opposite lateral sides thereof. By means of the wheels 10, the sit-up exercising apparatus can be conveniently moved on the floor after lifted the front side of the base frame 1 from the floor. The fixed seat cushion 2 is mounted on the base frame 1 at the front side. The swinging back cushion 5 has one end pivotally connected to a middle part of the base frame 1 behind the fixed seat cushion 2 by pivot pins 11. The stop frame bar 4 is selectively fastened to the longitudinal rows of mounting holes 12 of the base frame 1 and adapted to limit the swinging angel of the back cushion 5. When shifting the position of the stop frame bar 4 backwards from the fixed seat cushion 2, the swinging angle of the swinging back cushion 5 is relatively widened. On the contrary, when shifting the position of the stop frame bar 4 forwards toward the fixed seat cushion 2, the swinging angle of the swinging back cushion 5 is relatively reduced. The rear bracket 7 is fixedly fastened to the rear side of the base frame 1, having two U-lugs 50 respectively disposed at two distal ends thereof. The smoothly curved guide bars 8 are spaced from the swinging back cushion 5 at two sides, each having a rear end respectively connected to the U-lugs 50 of the rear bracket 7 and a front end respectively connected to the base frame 1. Further, a transverse bar 30 is transversely mounted on the back sidewall of the swinging back cushion 5. The handles 3 are fixedly connected to the two distal ends of the transverse bar 30 and equally spaced from two opposite lateral sides of the swinging back cushion 5, each having a bottom end fixedly mounted with a roller holder 51. The roller holder 51 holds two rollers 52 at different elevations. The rollers 52 are respectively supported on the top and bottom sides of one smoothly curved guide bar 8 to guide movement of the handles 3 The upper-sided one of the rollers 52 is coupled to the roller holder 51 by a slip joint 53 so that the handles 3 can be turned up and down when the user exercises the sit-up exercise.

Figure 4:
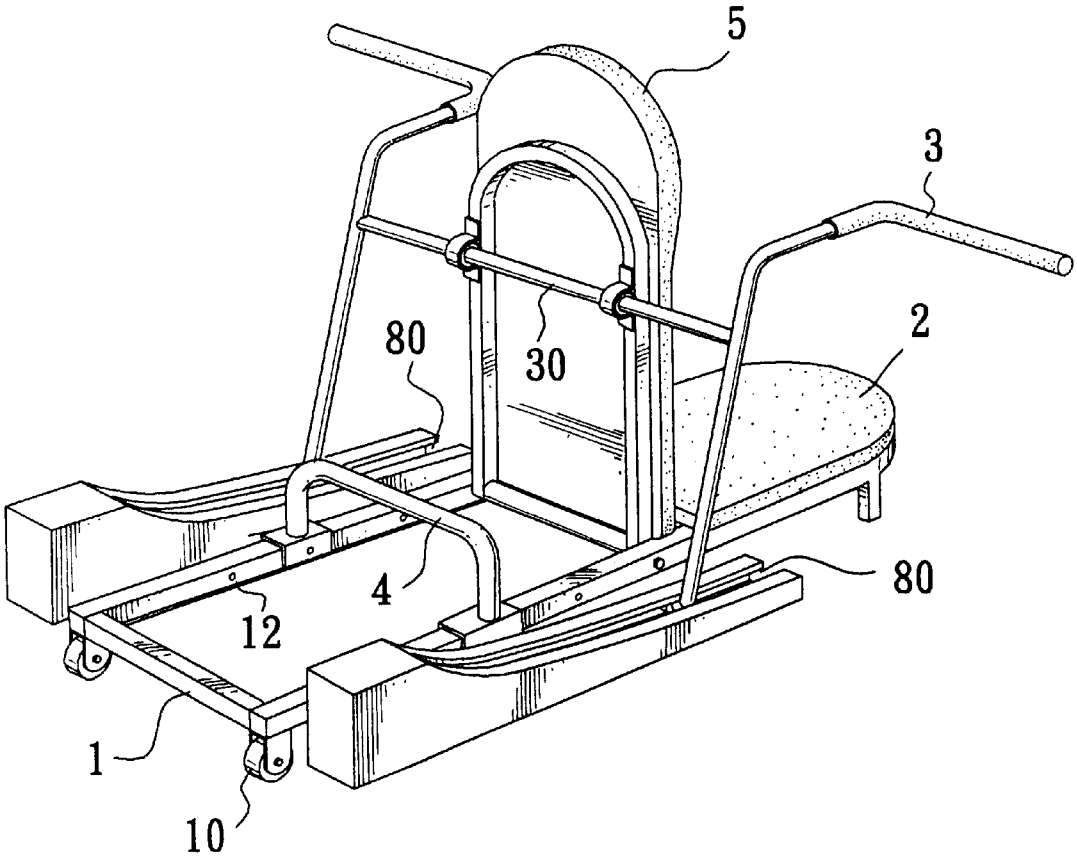
FIG. 4 is a perspective view of an alternate form of the sit-up exercising apparatus according to the present invention.
Figure 5:
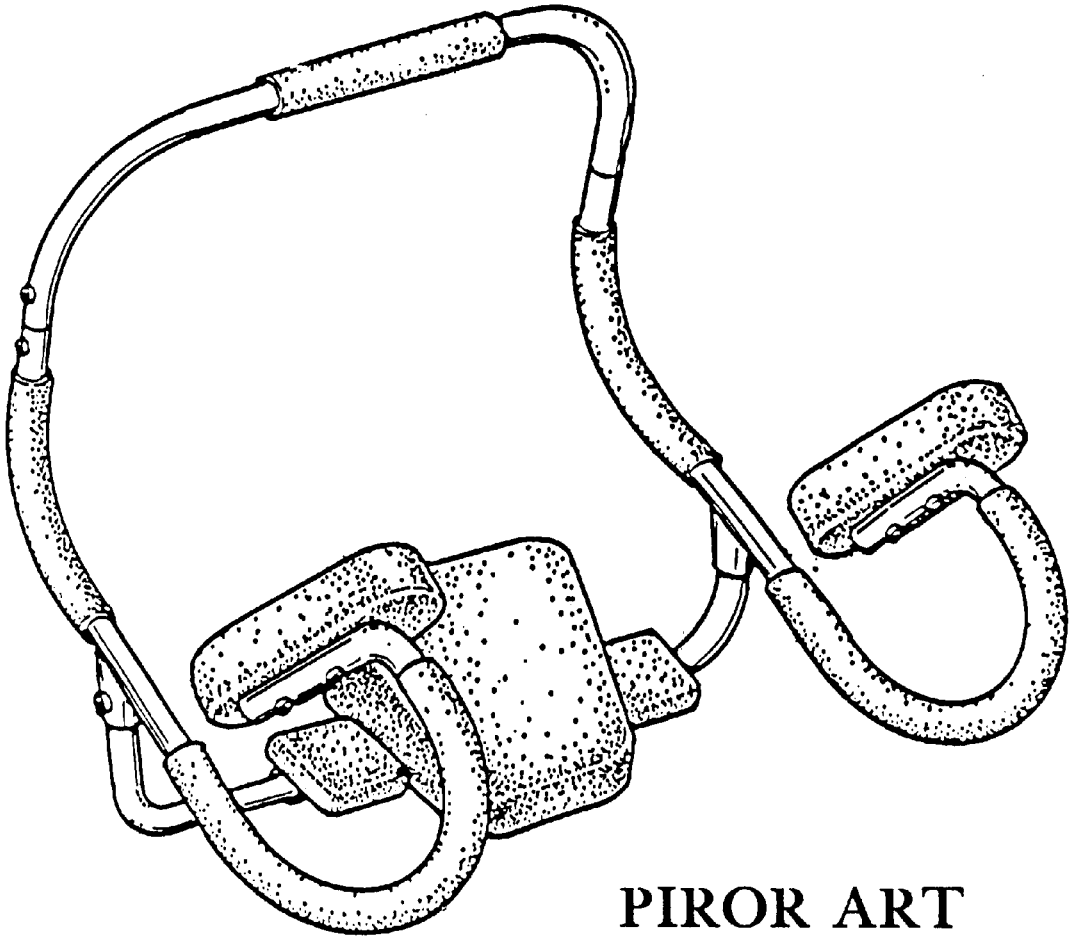
FIG. 5 is a perspective view of a sit-up exercising apparatus according to the prior art.

FIG. 4 shows an alternate form of the present invention. According to this alternate form, two sliding tracks 80 are provided at two sides of the base frame 1 instead of the aforesaid rear bracket 7 and the smoothly curved guide bar 8, and the rollers 52 of the roller holder 51 of each of the handles 3 are adapted to move with the roller holder 51 along the sliding tracks 80 along a smoothly curved path.

Figure 3:
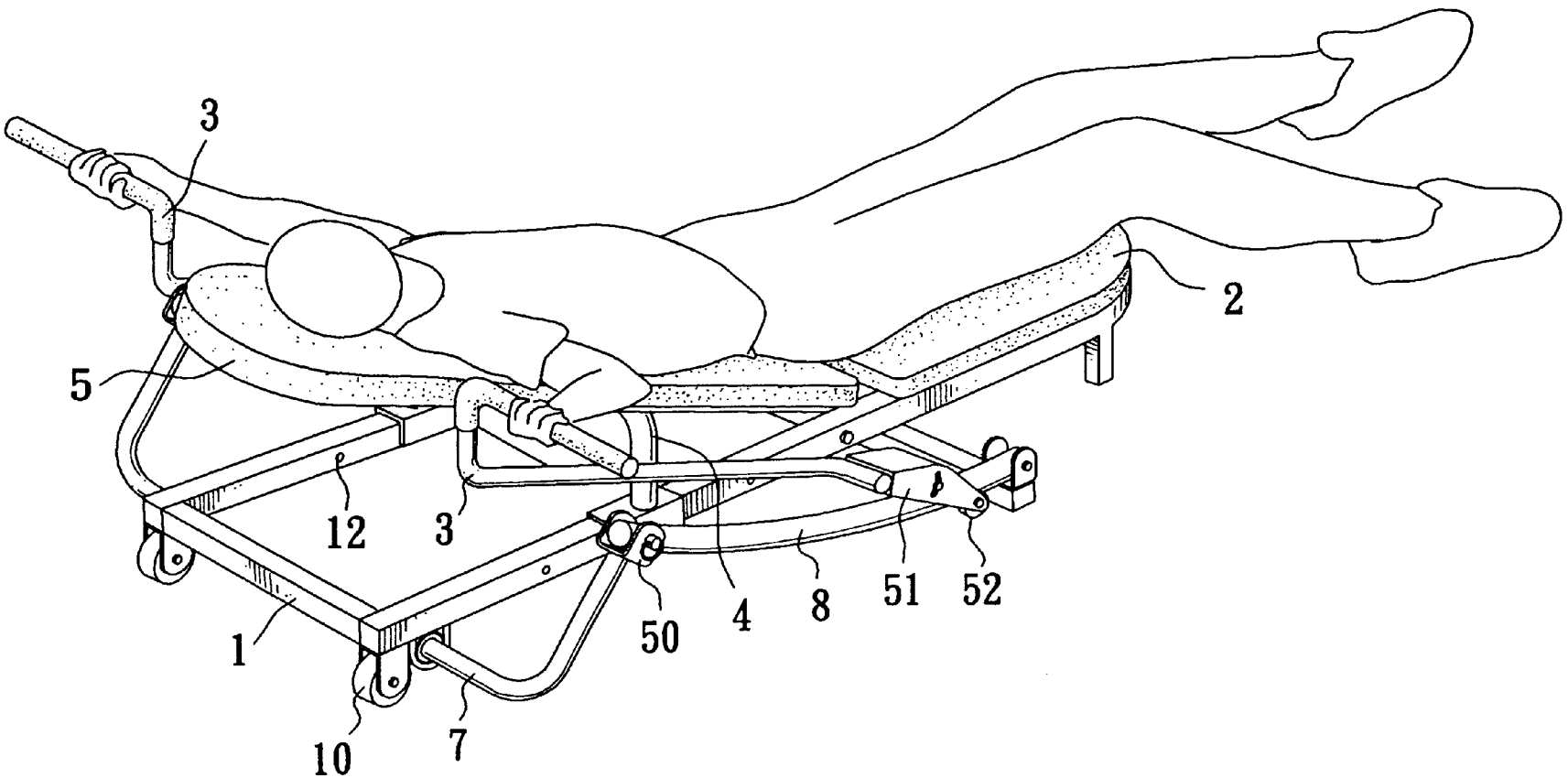
FIG. 3 is an applied view of the present invention.

Referring to FIG. 3 again, when in use, the base frame 1 is supported on the floor, and then the stop frame bar 4 is selectively fastened to the longitudinal rows of mounting holes 12 of the base frame 1 to limit the swinging angle of the swinging back cushion 5 to the desired range, and then the user sits on the fixed seat cushion 2 with the back supported on the back cushion 5, and then the user holds the handles 3 with the hands and turns the upper part of the body alternatively up and down when alternatively pulling and releasing the handles 3.

A prototype of sit-up exercising apparatus has been constructed with the features of FIGS. 1~4. The sit-up exercising apparatus functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A sit-up exercising apparatus comprising:

a base frame for positioning on the floor;

a fixed seat cushion fixedly mounted on said base frame at a front side of said base frame;

a swinging back cushion pivoted to a middle part of said base frame adjacent to said fixed seat cushion and turned up and down within an angle;

a stop frame bar fastened to said base frame and adapted to limit the swinging angle of said swinging back cushion;

two smoothly curved track means provided at two sides of said base frame;

a transverse bar transversely mounted on a back sidewall of said swinging back cushion; and two handles fixedly connected in parallel to two distal ends of said transverse bar, said handles each having a bottom end respectively coupled to said smoothly curved track means for enabling said handles to be moved along said smoothly curved track means when alternatively turned up and down.

2. The sit-up exercising apparatus of claim 1 wherein said base frame comprises two longitudinal series of mounting holes, and said stop frame bar is selectively fastened to the two longitudinal series of mounting holes of said base frame.

3. The sit-up exercising apparatus of claim 1 wherein said handles each comprise a roller holder fixedly provided at the respective bottom end, said roller holders holding a first roller supported on said smoothly curved track means at a top side and a second roller supported on said smoothly curved track means at a bottom side, said first roller being coupled to said roller holder by a slip joint.

4. The sit-up exercising apparatus of claim 1 wherein said handles each comprise a roller holder fixedly provided at the respective bottom end, said roller holders holding at least one roller adapted to move with said roller holder along said smoothly curved track means.

* * * * *